US005727859A

United States Patent [19]

Jeong et al.

[11] Patent Number: 5,727,859

[45] Date of Patent: Mar. 17, 1998

[54] STRUCTURE FOR ASSEMBLING AND LOCKING EVAPORATOR COVER ASSEMBLY IN REFRIGERATORS

[75] Inventors: Bu Gil Jeong; Ik Geun Kim, both of Suwon, Rep. of Korea

[73] Assignee: Samsung Electronics Co., Ltd., Suwon, Rep. of Korea

[21] Appl. No.: 694,295

[22] Filed: Aug. 8, 1996

[30] Foreign Application Priority Data

Dec. 26, 1995 [KR] Rep. of Korea ..... 95-56608

[51] Int. Cl.[6] ..... A47B 96/04

[52] U.S. Cl. ..... 312/404; 312/407; 312/407.1

[58] Field of Search ..... 312/400, 401, 312/404, 407, 407.1, 408, 348.2, 406; 62/465, 515, 516, 517, 518, 419, 408

[56] References Cited

U.S. PATENT DOCUMENTS

| | | | |
|---|---|---|---|
| 2,275,365 | 3/1942 | Hintze | 312/406 X |
| 4,042,288 | 8/1977 | Litchfield | 312/348.2 |
| 4,099,815 | 7/1978 | Cox et al. | 312/348.2 |
| 4,776,178 | 10/1988 | Buchser | 62/156 |
| 4,920,765 | 5/1990 | McCauley et al. | 62/408 |
| 4,944,157 | 7/1990 | Jenkins et al. | 62/465 X |
| 4,976,753 | 12/1990 | Huang | 312/107 X |
| 5,004,302 | 4/1991 | Stocking et al. | 312/408 |
| 5,076,070 | 12/1991 | Takushima et al. | 62/426 |
| 5,182,923 | 2/1993 | Trulaske, Sr. . | |
| 5,182,924 | 2/1993 | Trulaske, Sr. . | |
| 5,263,535 | 11/1993 | Philo et al. | 312/408 X |
| 5,369,963 | 12/1994 | Pickles et al. | 62/408 |
| 5,392,615 | 2/1995 | Lim | 62/408 X |
| 5,558,419 | 9/1996 | Dasher et al. | 312/408 X |
| 5,577,822 | 11/1996 | Seon | 312/407 X |

*Primary Examiner*—Peter M. Cuomo
*Assistant Examiner*—James O. Hansen
*Attorney, Agent, or Firm*—Burns, Doane, Swecker & Mathis, L.L.P.

[57] ABSTRACT

A refrigerator forms a freezer compartment in which an evaporator is mounted. The evaporator includes a cover assembly composed of front and rear covers locked together by a projection/opening connection. The rear cover includes an elastic tongue in which the opening is formed. The from cover includes the projection, and the projection elastically deforms the tongue as it approaches the opening. Then the tongue rebounds elastically to insert the projection into the opening to lock the covers together. The tongue also carries another projection which elastically enters a channel formed in the refrigerator housing to lock the cover assembly to the housing.

5 Claims, 4 Drawing Sheets

STRUCTURE FOR ASSEMBLING AND LOCKING EVAPORATOR COVER ASSEMBLY IN REFRIGERATORS

BACKGROUND OF THE INVENTION 1. Field of the Invention

The present invention relates in general to a structure for assembling and locking an evaporator cover assembly in refrigerators. 2. Description of the Prior Art As well known to those skilled in the art, the interior of a refrigerator 10 is typically partitioned into two compartments, that is, a freezer compartment 12 in the upper section and a fresh food compartment 13 in the lower section, by a partition horizontally extending between the two compartments of the refrigerator 10 as shown in FIG. 1 .

The temperatures inside the compartments 12 and 13 are appropriately controlled by an evaporator 14 mounted to the rear wall of the freezer compartment 12. The cool air, which has a temperature no higher than the freezing point and is generated by the heat exchanging operation performed by the evaporator 14, is distributed to both compartments 12 and 13 through a cool air distributing grille 3 formed on the front cover 2 of the evaporator 14. The cool air inside the compartments 12 and 13 absorbs heat from food in the compartments 12 and 13 and returns to the evaporator 14 where the air loses heat. Therefore, the freezing compartment 12 keeps food while freezing it. On the other hand, the fresh food compartment 13 keeps food while cooling it to a low temperature. In FIG. 1, the reference numeral 15 denotes a defrosted water guider for gathering and guiding defrosted water dropping from the evaporator 14, the numeral 16 denotes a defrosted water drain pipe, the numeral 17 denotes a drain tray, and the numeral 18 denotes a compressor for compressing the refrigerant to a high pressure.

As disclosed in U.S. Pat. Nos. 5,182,923 and 5,182,924, the evaporator of a refrigerator has been typically mounted to the rear wall inside the freezing compartment using connecting members such as set screws.

U.S. Pat. No. 5,263,535 discloses a device for mounting the evaporator along with an evaporator cover assembly to the rear wall of a refrigerator cabinet inside the freezer compartment.

In the above mounting device, a rear cover 1 is mounted to the rear wall of the refrigerator cabinet or housing inside the freezer compartment using a plurality of screws 5 prior to installing the evaporator body (not shown) in the space of the rear cover 1 as shown in FIG. 2. Thereafter, a front cover 2 is locked to the rear cover 1 by inserting a protrusion 2*a* of the front cover 2 into a slot 1*a* of the rear cover 1 as shown in FIG. 3, thereby assembling the covers 1 and 2 into a cover assembly mounted to the rear wall of the freezer compartment. In FIG. 2, the reference numeral 3 denotes the cool air distributing grille for guiding the cool air of the evaporator to the freezer compartment.

However, the typical structure for assembling the front and rear covers into the evaporator cover assembly and mounting the assembly to the rear wall inside the freezer compartment has the following problems. That is, since the plurality of screws 5 must be driven one by one while mounting the rear cover 1 to the rear wall, it is somewhat difficult to mount the evaporator cover assembly inside the freezer compartment. Therefore, the cover assembly which must be screwed to the rear wall reduces manufacturing productivity and complicates the process for producing the refrigerators.

While assembling the front and rear covers 2 and 1 together to form the evaporator cover assembly, the front cover 2 must be locked to the rear cover 1 by forcibly inserting the protrusion 2*a* of the front cover 2 into the slot 1*a* of the rear cover 1, so that the front cover 2 is difficult to separate from the rear cover 1. The above forcible locking of the front cover 2 to the rear cover 1 also may cause the covers 1 and 2 to break while together the covers 1 and 2. In order to prevent the covers 1 and 2 from breaking, the front cover may have a larger size than that of the rear cover. However, the size difference between the two covers 1 and 2 results in the formation of a gap at the junction between the covers 1 and 2, so that the different sizes of the covers 1 and 2 causes leaking of the cool air through the gap.

SUMMARY OF THE INVENTION

It is, therefore, an object of the present invention to provide a structure for assembling front and rear covers into an evaporator cover assembly and locking the cover assembly inside a refrigerator in which the above problems can be overcome and which lets the front and rear covers be detachably assembled into the cover assembly by elastically locking the front cover to the rear cover.

It is another object of the present invention to provide a structure for assembling front and rear covers into an evaporator cover assembly and locking the cover assembly inside a refrigerator which lets the cover assembly, formed by elastically locking the front cover to the rear cover, be elastically locked inside the freezer compartment.

In order to accomplish the above object, the structure for assembling and locking an evaporator cover assembly in refrigerators according to an embodiment of this invention comprises a first protrusion formed on a front cover, a slot formed on a rear cover at a portion corresponding to the first protrusion to elastically receive the protrusion therein while assembling the front and rear covers into the cover assembly, a refrigerator cabinet provided in a freezer compartment for locking the cover assembly therein, and a slit formed on the rear cover to surround the slot thereby forming an elastic tongue on the rear cover.

In another embodiment of this invention, the structure further includes a second protrusion formed on the elastic tongue of the rear cover, and an upward-grooved channel formed on the cabinet at a portion corresponding to the second protrusion to elastically receive the second protrusion therein while locking the cover assembly inside the cabinet.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF A PREFERRED EMBODIMENT

Figure 1:
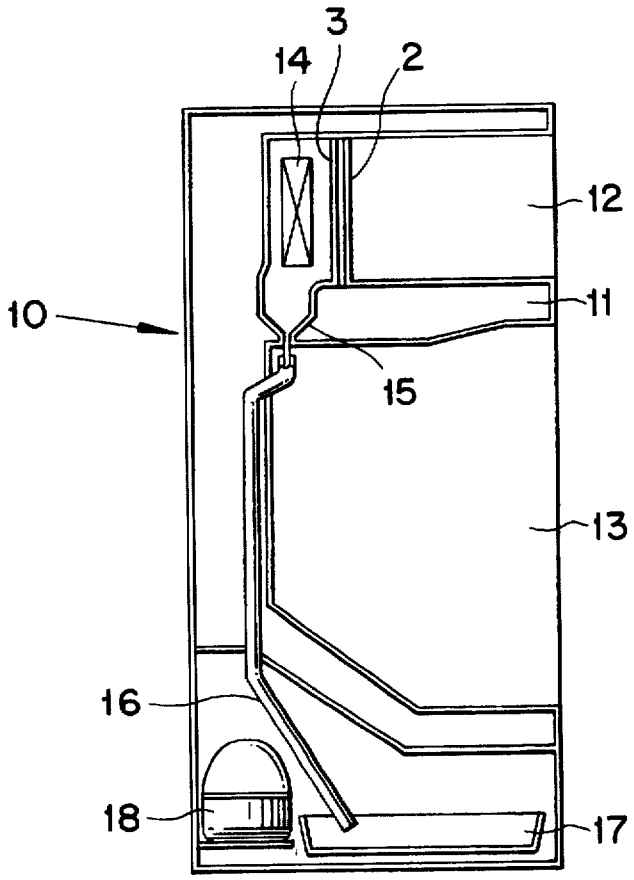
FIG. 1 (PRIOR ART)
FIG. 1 is sectional view showing the construction of a typical refrigerator.
Figure 2:
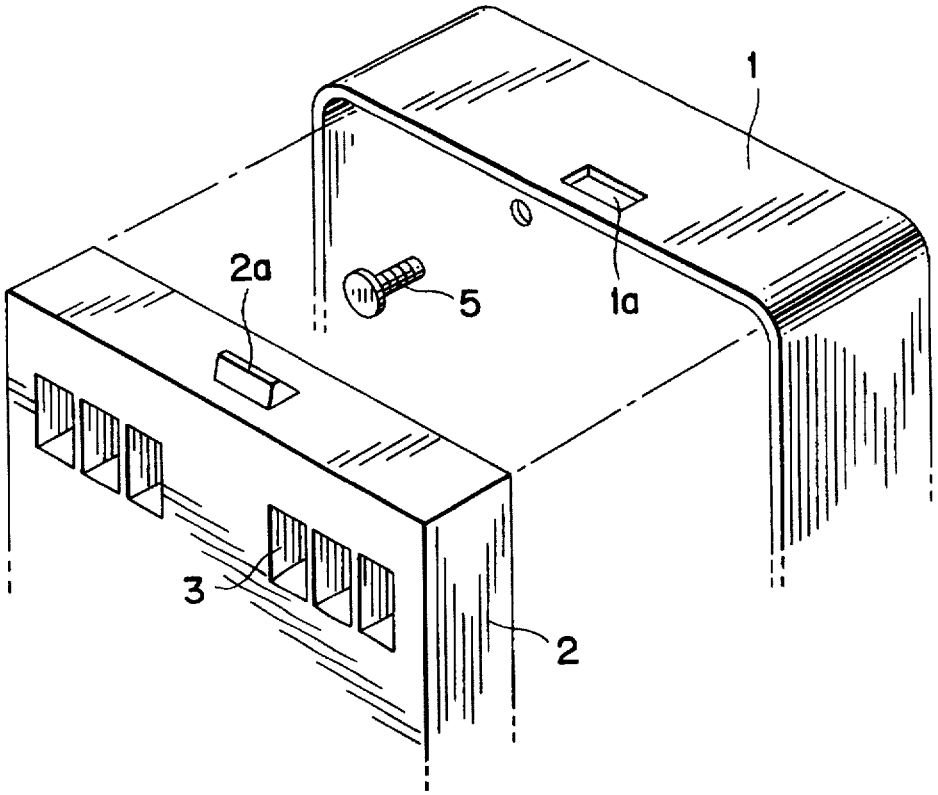
FIG. 2 (PRIOR ART)
FIG. 2 is an exploded perspective view showing a typical locking structure for assembling front and rear covers together to form an evaporator cover assembly and mounting the cover assembly to the freezer compartment of the refrigerator.
Figure 3:
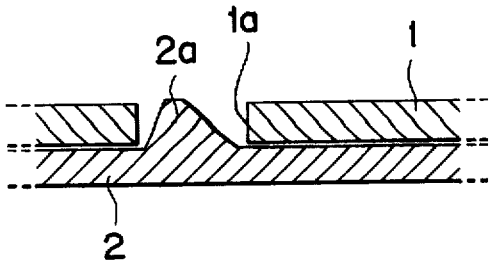
FIG. 3 (PRIOR ART)
FIG. 3 is a freqmentory view of the locking structure of FIG. 2.

Most of the elements of the preferred embodiment of this invention are common with those of the prior embodiment of FIGS. 2 and 3. The elements common to both the embodiment of this invention and the prior embodiment will thus carry the same reference numerals and description thereof is omitted.

Figure 4:
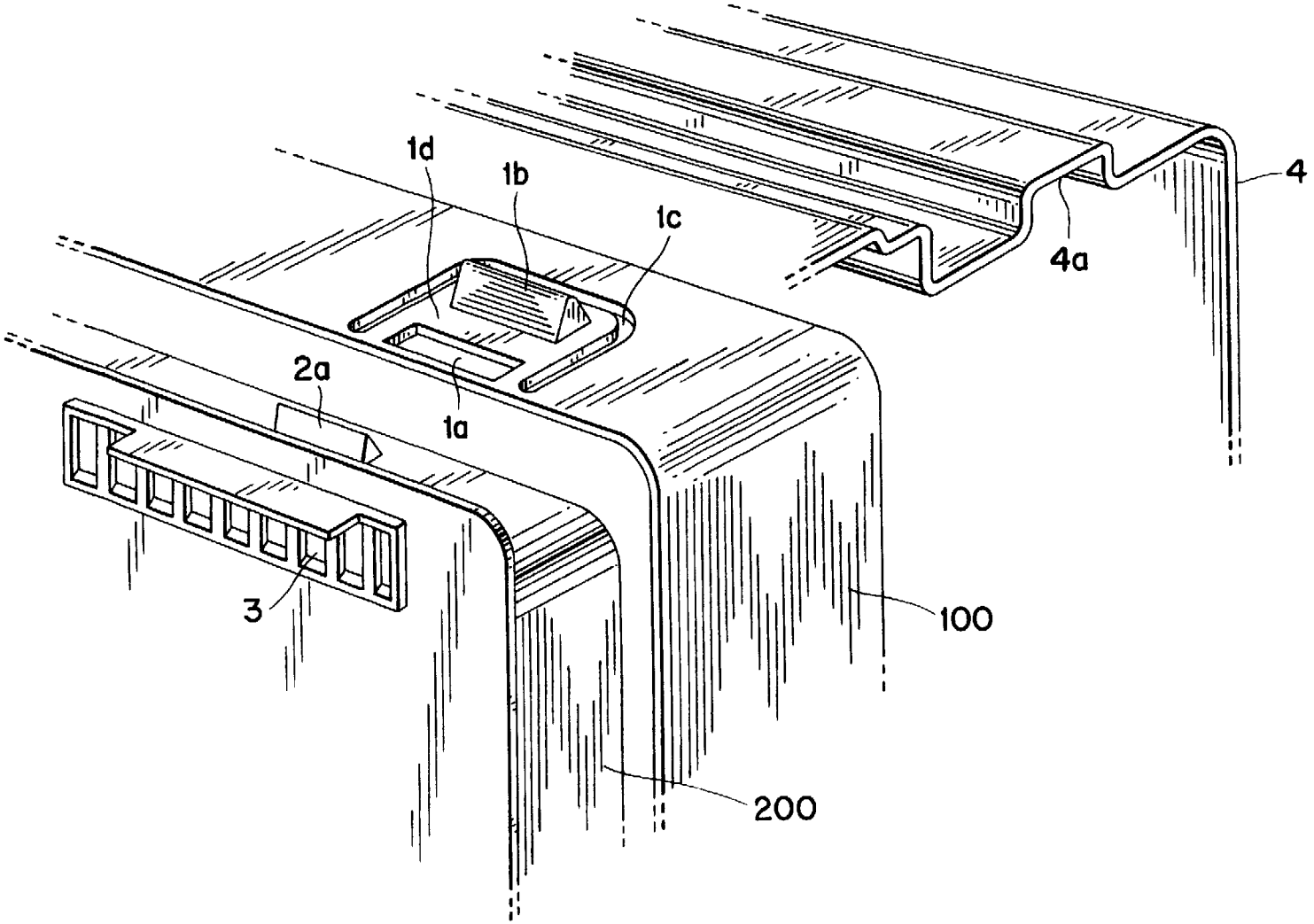
FIG. 4 is an exploded perspective view showing a locking structure for assembling front and rear covers to form an evaporator cover assembly and mounting the cover assembly inside the freezer compartment of a refrigerator in accordance with a preferred embodiment of the present invention.
Figure 5:
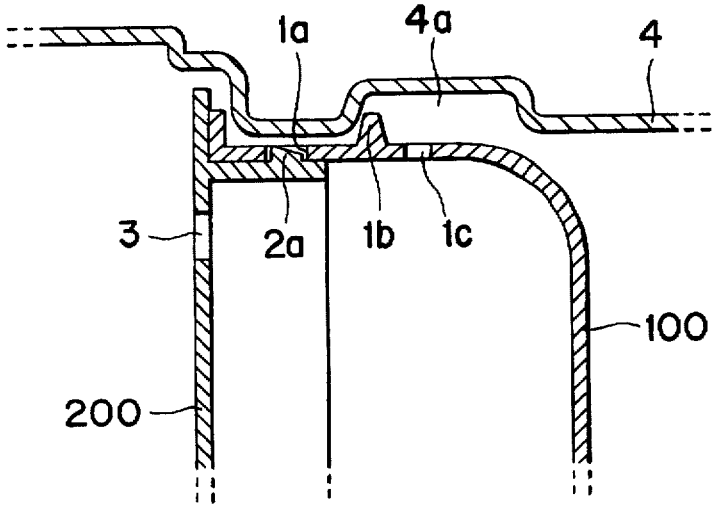
FIG. 5 is an enlarged sectional view of the locking structure according to this invention.

FIGS. 4 and 5 show a locking structure for assembling front and rear covers into an evaporator cover assembly and mounting the cover assembly inside the evaporator cabinet of the freezer compartment of a refrigerator in accordance with a preferred embodiment of this invention. As shown in FIGS. 4 and 5, the locking structure of this invention comprises a first protrusion 2*a* formed on the front cover 200. The structure also includes a on opening 1*a* which is formed on the rear cover 100 at a position corresponding to the first protrusion 2*a* for elastically receiving the protrusion 2*a* therein. The cover assembly, formed by elastically inserting the first protrusion 2*a* into the slot 1*a*, is mounted to the refrigerator cabinet 4 inside the freezer compartment.

In order to let the first protrusion 2*a* be elastically and detachably locked into the slot 1*a*, a U-shaped slit 1*c* is formed on the rear cover 100 to surround the slot 1*a* thereby forming an elastic tongue 1*d* inside the slit 1*c*.

In order to elastically and detachably mount the cover assembly to the refrigerator cabinet 4, a second protrusion 1*b* is formed on the tongue 1*d*. The refrigerator cabinet 4 has an upward-grooved channel 4*a* for elastically recieving the second protrusion 1*b* and thereby detachably locking the cover assembly to the cabinet 4.

The operational effect of the above-described locking structure will be described hereinbelow.

In order to assemble the rear and front covers 100 and 200, together to form into the evaporator cover assembly, the front cover 200 is fitted into the rear cover 100 in telescoping fashion, with an evaporator body (not shown) disposed inside the covers 100 and 200. In the above state, the elastic tongue 1*d* of the rear cover 100 is elastically deformed upward by the first protrusion 2*a* as the protrusion 2*a* approaches the slot 1*a*. The protrusion 2*a* enters the slot 1*a* as the tongue elastically rebound to its original position thereby somewhat stably locking the front cover 200 to the rear cover 100. The rear and front covers 100 and 200 are thus elastically and detachably assembled together to form the evaporator cover assembly.

The cover assembly in turn is fitted into the cabinet 4 inside the freezer compartment. In the above state, the second protrusion 1*b* is pushed downward by the cabinet 4 thereby elastically pushing the tongue 1*d* of the cover 100 downward until the protrusion 1*b* is completely received in the channel 4*a* of the cabinet 4. When the second protrusion 1*b* is completely received in the channel 4*a* of the cabinet 4, the tongue elastically returns to its original position, so that the cover assembly is elastically and detachably locked to the cabinet 4.

As described above, the present invention provides a structure for elastically assembling front and rear covers embodiment an evaporator cover assembly and elastically locking the cover assembly to the refrigerator cabinet inside the freezer compartment of a refrigerator. The structure thus allows easy assembly of the covers into the cover assembly and locks the cover assembly to the refrigerator cabinet without using any connecting members such as set screws. The structure also lets the cover assembly be easily separated from the cabinet and disassembled into the covers. Therefore, the structure simplifies the refrigerator producing process and manufacturing productivity.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A refrigerator comprising:

a housing forming an internal compartment and including a channel; and a cover assembly mounted in said compartment and adapted for enclosing an evaporator mechanism, said cover assembly comprising:

a front cover, and a rear cover, connected to said front cover in telescoping fashion, one of said front and rear covers including a protrusion, and the other of said front and rear covers including an opening for receiving said protrusion to lock said front and rear covers together, said protrusion comprising a first protrusion, there being a second protrusion disposed on said tongue and received in said channel to lock said cover assembly to said housing, one of said opening and protrusion being partially surrounded by a slot to form an elastic tongue on which said one of said opening and protrusion is disposed, said tongue being deformable elastically as said opening and protrusion approach one another during assemblage of said front and rear covers together prior to rebounding to insert said protrusion into said opening.

2. The refrigerator according to claim 1 wherein said slot partially surrounds said opening.

3. The refrigerator according to claim 2 wherein said front cover is received within said rear cover, said tongue disposed on said rear cover.

4. The refrigerator according to claim 1 wherein said tongue is disposed on said rear cover.

5. The refrigerator according to claim 1 wherein said compartment is a freezer compartment.

* * * * *